US006135514A

United States Patent [19]

Kowalewski et al.

[11] Patent Number: 6,135,514

[45] Date of Patent: Oct. 24, 2000

[54] AUTOMOTIVE VEHICLE STORAGE COMPARTMENT RELEASE MECHANISM

[75] Inventors: Thomas Joseph Kowalewski, Rochester Hills; Daniel William Danko, Farmington Hills, both of Mich.

[73] Assignee: Delphi Technologies, Inc., Troy, Mich.

[21] Appl. No.: 09/396,680

[22] Filed: Sep. 13, 1999

[51] Int. Cl.[7] ..... E05C 3/06

[52] U.S. Cl. ..... 292/216; 292/225; 292/DIG. 62

[58] Field of Search ..... 292/336.3, 216, 292/DIG. 38, DIG. 43, DIG. 63, DIG. 65, DIG. 71, 125, 225, 171, DIG. 62; 362/84, 100, 496, 501

[56] References Cited

U.S. PATENT DOCUMENTS

| | | | |
|---|---|---|---|
| 530,144 | 12/1894 | Wegmann | 292/171 |
| 932,232 | 8/1909 | Adams | 292/116 |
| 1,526,887 | 2/1925 | Meter | 292/225 |
| 1,637,910 | 8/1927 | Morrison | 292/225 |
| 1,910,102 | 5/1933 | Godfrey | 16/381 |
| 3,565,475 | 2/1971 | Foss | 292/171 |
| 4,130,310 | 12/1978 | Kessie | 292/340 |
| 4,155,233 | 5/1979 | Lira | 70/92 |
| 5,445,326 | 8/1995 | Ferro | 292/336 |
| 5,580,153 | 12/1996 | Motz | 362/80 |
| 5,584,561 | 12/1996 | Lahos | 362/72 |
| 5,859,479 | 1/1999 | David | 307/10.8 |
| 5,975,714 | 11/1999 | Vetorino | 362/192 |
| 6,026,705 | 2/2000 | Ficyk | 74/500.5 |

*Primary Examiner*—B. Dayoan
*Assistant Examiner*—Gary Estremsky
*Attorney, Agent, or Firm*—Patrick M. Griffin

[57] ABSTRACT

Latch release mechanism for a latch of the lid of a trunk storage compartment of an automobile. A detent retains the latch in a latching position holding the lid closed. The detent can be withdrawn from the latch-retaining position enabling the latch to be moved by a spring to the release position permitting the lid to be opened. A cable within the trunk can be used to withdraw the detent. An electric charge storage device is charged in response to movement of the trunk lid from closed to open position. A light-emitting device is energized by the electric charge storage device to illuminate the trunk for a period of time after the trunk lid is closed to make it easy for a person to find and operate the cable.

7 Claims, 2 Drawing Sheets

AUTOMOTIVE VEHICLE STORAGE COMPARTMENT RELEASE MECHANISM

FIELD OF THE INVENTION

This invention relates generally to a latch release mechanism for the closure of an automotive vehicle storage compartment and more particularly to a latch release mechanism that is manually operable from within the storage compartment.

BACKGROUND OF THE INVENTION

Normally, the latch mechanism for keeping the trunk lid closed can be released easily from outside the vehicle using a mechanical key or an electronic transmitter. The electronic transmitter can also be used by a person inside the passenger compartment. Typically, there is no mechanism to open the trunk lid from inside the trunk. It is desired to provide an effective means to release the latch for the trunk lid from inside the trunk compartment.

SUMMARY OF THE INVENTION

In accordance with the present invention, a latch release mechanism for the latch of a lid of a vehicle storage compartment is provided which is operable from a position within the storage compartment. In addition, illumination is provided in the storage compartment after the lid is closed, making it easier for a person trapped in the storage compartment to locate and operate the release mechanism.

Preferably the mechanism includes a detent for retaining the latch in a latching position holding the lid closed. The detent is movable away from the latch-retaining position to enable the latch to be moved to the release position, permitting the lid to be opened. A spring is provided for moving the latch to the release position.

The detent can be moved away from its latch-retaining position by an actuator within the storage compartment. Preferably the actuator includes a cable which can be operated in the manner of a "bus pull." The detent may also be operated by a second actuator operated from a position outside the storage compartment.

Illumination for the storage compartment preferably is provided by a light-emitting device energized by an electric charge storage device. The electric charge storage device is charged in response to movement of the lid from the closed to the open position. Whenever the lid is opened, the storage device receives a charge sufficient to energize the light-emitting device for a sufficient period of time after the lid is closed to make it easy for a person trapped in the storage compartment to find and operate the latch release mechanism.

One object of this invention is to provide a latch release mechanism having the foregoing features and capabilities.

Another object is to provide a latch release mechanism which is capable of being operated from inside the storage compartment, with illumination provided to enable finding the release mechanism, and which is composed of a few simple parts, yet which is capable of performing its intended purpose in an efficient and reliable manner.

These and other objects, features and advantages of the invention will become more apparent as the following description proceeds, especially when considered with the accompanying drawings.

DETAILED DESCRIPTION OF THE PREFERRED EMBODIMENT

Figure 1:
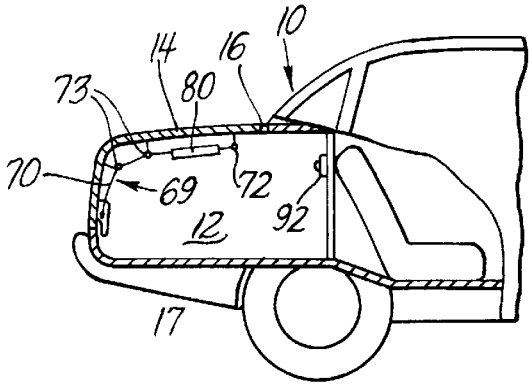
FIG. 1 is a side elevational view, partly in section, of the rear portion of an automobile, showing the rear trunk storage compartment, a lid for opening and closing the compartment, and a latch and latch release mechanism within the compartment constructed in accordance with the invention.

Referring now more particularly to the drawings, there is shown in FIG. 1 a vehicle 10 having a trunk storage compartment 12 closed by a lid 14. The lid 14 is pivoted at 16 to swing between the closed position shown and an open position. A latch and latch release mechanism 17 for the lid is provided inside the storage compartment 12.

The lid 14 is held closed by a latch 18 of mechanism 17 that pivots on pin 20 that is attached to a frame 22. The frame 22 is mounted in a fixed position on the inner surface of the lid, so that it is inside the trunk compartment when the lid is closed. The latch 18 pivots on the pin 20 between a latching position shown in FIG. 3 and a release position shown in FIG. 2. The latch 18 cooperates with a striker 24 secured to the body 26 of the vehicle in holding the lid closed. The latch 18 has a generally C-shaped portion 28 defined by two spaced apart legs 30 and 32 with a slot 34 between the legs. When the latch is in the latching position of FIG. 3, the C-shaped portion 28 grips the striker 24 which extends into the slot 34, holding the lid in the closed position. When the latch is pivoted to the FIG. 2 release position, the C-shaped portion 28 of latch 18 withdraws from the striker 24 to permit the lid to be opened.

Figure 2:
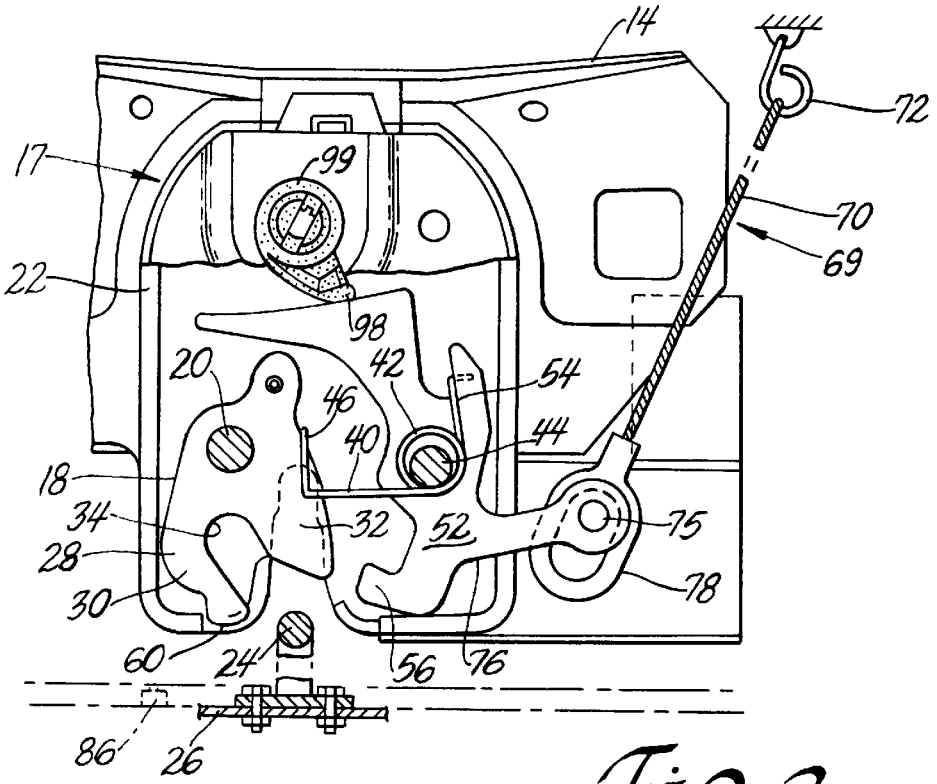
FIG. 2 is an enlarged fragmentary view of the latch and latch release mechanism inside the trunk compartment, showing the latch in the released position.

The latch 18 is urged to the release position of FIG. 2 by a spring 40. The spring 40 has a body portion 42 coiled about a pivot pin 44 on the frame 22. The spring has an arm 46 pressing on the latch 18 to urge it clockwise to the release position of FIG. 2.

Figure 3:
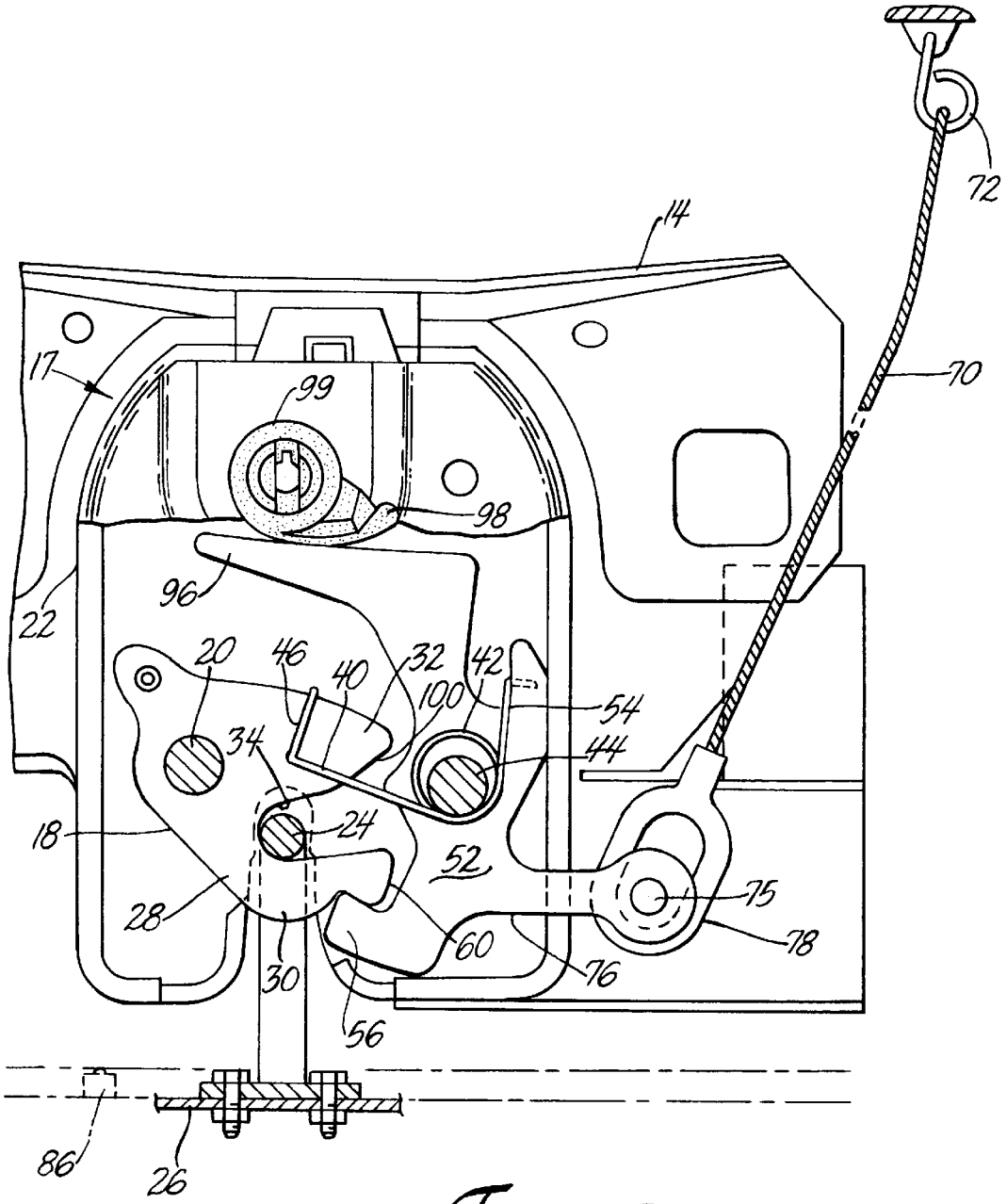
FIG. 3 is a view similar to FIG. 2 but shows the latch in the latching position.

A detent 52 is provided to lock or retain the latch 18 in the latching position of FIG. 3. The detent is pivoted on the pivot pin 44 and is urged clockwise by an arm 54 on the spring 40 toward the FIG. 3 position. The detent 52 has a hook 56 which in the FIG. 3 position is adapted to engage a projection 60 on the latch 18 to prevent the latch from turning clockwise and away from the latching position of FIG. 3.

When the detent 52 is retracted from the position of FIG. 3 to the position of FIG. 2, the latch 18 is released and rotated to the release position of FIG. 2 by the arm 46 on the spring 40.

A latch release actuator 69 includes an elongated flexible, cable 70 which has one end engaged with an anchor hook 72 inside the trunk storage compartment 12. Cable 70 extends through guide loops 73. A pin 75 on an arm 76 of the detent 52 extends through a slot of ring-shaped link 78 on the other end of cable 70 so that when cable 70 is pulled, detent 52 is rotated counterclockwise to release latch 18. Preferably cable 70 has a gripping sleeve 80 and may be manually operated like a "bus pull" by merely pulling down on sleeve 80 to rotate detent 52 counterclockwise to the release position shown in FIG. 2.

Figure 4:
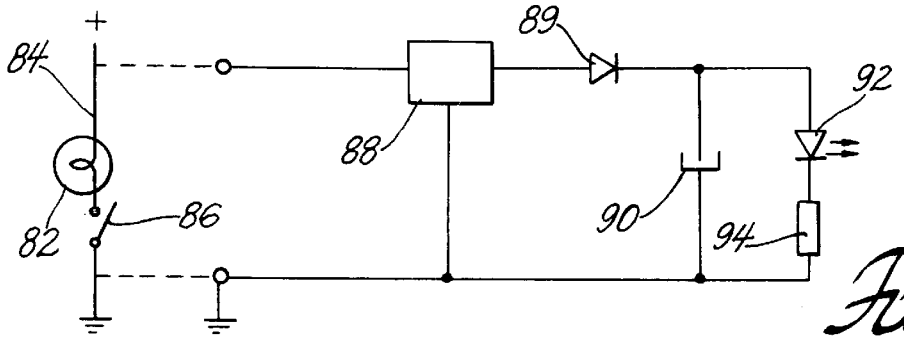
FIG. 4 is a diagram showing the means for illuminating the compartment after the trunk lid has been closed.

FIG. 4 shows a light bulb 82 inside the trunk compartment. This is the usual light bulb for illuminating the trunk compartment when the lid is moved to open position. The light bulb 82 is in a circuit 84 which is closed by a switch 86 when the trunk lid 14 is opened. A voltage regulator 88 receives current from the circuit 84 when the switch 86 is closed. The voltage regulator 88 may be set to transmit through a blocking or directional diode 89 about 5 volts to an electric charge storage device (capacitor) 90. The charge storage device 90 receives and stores an electric charge whenever the switch 86 is closed by the opening of trunk lid 14. The charge storage device 90 will charge in about 10 seconds and energizes an illuminator, which may, for example, be a flashing light-emitting device (LED) 92, through a resistor 94. The charge storage device 90 will continue to energize the LED after the trunk lid is closed, so that the LED will continue to flash brightly for as long as fifteen minutes and with lesser intensity for up to two hours. A person trapped in the trunk may then have sufficient illumination and sufficient time to locate the pull cable 70 and retract the detent 52 to release the trunk latch 18.

The detent 52 has a second arm 96 which is engagable by a cam 98 on a cylinder 99 mounted on the frame 22. The cylinder 99 may be operated from outside the trunk storage compartment by a key to rotate the cam 98 and retract the detent 52 counterclockwise against the pressure of the spring 40 to release the latch as shown in FIG. 2.

When the trunk lid 14 is moved to closed position, an inside surface 100 of the leg 32 of the latch 18 engages the striker 24 to pivot the latch from the FIG. 2 position to the FIG. 3 position, latching the trunk lid 14 in the closed position.

We claim:

1. The combination of a vehicle storage compartment and a latch release mechanism for a latch of a lid of the vehicle storage compartment), the latch when moved to a release position permitting the lid to be moved from closed to open position relative to the compartment, comprising:

a detent movable from a latch-retaining position retaining the latch in a latching position holding the lid in closed position to a retracted position enabling the latch to be moved to the release position to permit the lid to be moved to the open position thereof, means for moving the latch to the release position thereof when said detent is moved to its retracted position, and first actuator means manually operable from a position within the compartment for moving the detent from the latch-retaining position to the retracted position thereof, the first actuator means including an elongated flexible cable that has a first end attached to the detent and a second end attached to a fixed anchor within the compartment, the first end being attached to the detent by a lost motion connection comprising a pin and an elongated slot.

2. The combination as defined in claim 1, wherein the means for moving the latch to the latch release position includes a spring that has an arm bearing against the detent urging the detent toward its latch-retaining position.

3. The combination of a vehicle storage compartment and a latch release mechanism for a latch of the lid of a vehicle storage compartment, the latch when moved to a release position permitting the lid to be moved from closed to open position relative to the compartment, comprising:

a detent movable from a latch-retaining position retaining the latch in a latching position holding the lid in closed position to a retracted position enabling the latch to be moved to the release position to permit the lid to be moved to the open position thereof, means for moving the latch to the release position thereof when said detent is moved to its retracted position, and first actuator means manually operable from a position within the compartment for moving said detent from the latch-retaining position to the retracted position thereof, the first actuator means including an elongated flexible cable, and means for illuminating the compartment after the lid is moved from the open to the closed position thereof, the means for illuminating the compartment having an electric charge storage device, means for charging the electric storage device in response to movement of the lid from closed to open position, and a light emitting device operated by the electric charge storage device.

4. The combination of a vehicle storage compartment and a latch release mechanism for a latch of a lid of the vehicle storage compartment, the latch when moved to a release position permitting the lid to be moved from closed to open position relative to the compartment, comprising:

a detent movable from a latch-retaining position retaining the latch in a latching position holding the lid in closed position to a retracted position enabling the latch to be moved to the release position to permit the lid to be moved to the open position thereof, means for moving the latch to the release position thereof when the detent is moved to its retracted position, first actuator means manually operable from a position within the compartment for moving said detent from the latch-retaining position to the retracted position thereof, second actuator means operable from a position outside said compartment for moving the detent from the latch-retaining position to the retracted position thereof, the first actuator means including an elongated flexible cable having a first end connected to a first arm of the detent by a lost motion connection, and the second actuator means comprises a pivoted cam engagable with a second arm of the detent, and the cable having a second end secured to a fixed anchor, and the first end being connected to the first arm of the detent by a lost motion connection so that the second actuator means can move the detent back and forth between from the latch retaining position and the retracted position thereof without disturbing the elongated flexible cable.

5. The combination as defined in claim 4, wherein the means for moving the latch to the latch release position includes a spring that has an arm bearing against the detent urging the detent toward its latch-retaining position, the spring having a second arm bearing against the detent urging the detent toward its latch-retaining position.

6. The combination as defined in claim 5 further including means for illuminating the compartment after the lid is moved from the open to the closed position thereof.

7. The means for illuminating the compartment includes the combination of a vehicle storage compartment and a latch release mechanism for a latch of a lid of the vehicle storage compartment, the latch when moved to a release position permitting the lid to be moved from closed to open position relative to the compartment, comprising:

a detent movable from a latch-retaining position retaining the latch in a latching position holding the lid in closed position to a retracted position enabling the latch to be moved to the release position to permit the lid to be moved to the open position thereof, means for moving the latch to the release position thereof when said detent is moved to its retracted position, first actuator means manually operable from a position within the compartment for moving the detent from the latch-retaining position to the retracted position thereof, and second actuator means operable from a position outside the compartment for moving the detent from the latch-retaining position to the retracted position thereof, the first actuator means including an elongated flexible cable having a first end connected to a first arm of the detent by a lost motion connection, and said second actuator means having a pivoted cam engagable with a second arm of said detent, the cable having a second end secured to a fixed anchor, the means for moving the latch to the latch release position including a spring that has an arm bearing against the detent urging the detent toward its latch-retaining position, the spring having a second arm bearing against the detent urging the detent toward its latch retaining position, and means for illuminating the compartment after the lid is moved from the open to the closed position thereof, including an electric charge storage device, means for charging the electric charge storage device in response to movement of the lid from the closed to open position, and a light-emitting device operated by the electric charge storage device.

* * * * *